US007604141B1

(12) United States Patent
Taylor

(10) Patent No.: US 7,604,141 B1
(45) Date of Patent: Oct. 20, 2009

(54) INTERMODAL CONTAINER MODULAR UNIT

(76) Inventor: John C Taylor, 850 Camino Viejo, Montecito, CA (US) 93108

( * ) Notice: Subject to any disclaimer, the term of this patent is extended or adjusted under 35 U.S.C. 154(b) by 220 days.

(21) Appl. No.: 11/846,202

(22) Filed: Aug. 28, 2007

Related U.S. Application Data

(60) Provisional application No. 60/847,047, filed on Sep. 25, 2006.

(51) Int. Cl.
*B65D 88/00* (2006.01)
*E04H 1/02* (2006.01)

(52) U.S. Cl. ..... 220/1.5; 52/79.1; 52/79.7

(58) Field of Classification Search ..... 220/1.5, 220/4.28, 4.21; 52/64, 65, 79.1, 79.7, 100
See application file for complete search history.

(56) References Cited

U.S. PATENT DOCUMENTS 4,854,094 A * 8/1989 Clark ..... 52/79.1
5,353,558 A * 10/1994 Shea et al. ..... 52/143
5,732,839 A * 3/1998 Schimmang et al. ..... 220/1.5
5,966,956 A * 10/1999 Morris et al. ..... 62/259.1
6,772,563 B2 * 8/2004 Kuhn ..... 52/67
7,000,795 B2 * 2/2006 Serden ..... 220/1.5

* cited by examiner

*Primary Examiner*—Harry A Grosso
(74) *Attorney, Agent, or Firm*—Laura N Tunnell

(57) ABSTRACT

A modular housing unit is fabricated from an intermodal cargo container. The rectangular box comprising the cargo container is cut into three sections. A right triangular section is fabricated from a center portion. The remaining portion is folded to form a "L"-shaped structure. The triangular section is reinserted into the vertex of the "L" to form a substantially triangular housing unit. A door is cut therein to provide means for entering the building. Intermodal cargo containers ranging from 20-53 feet in length can thus be employed to provide up to 424 square feet of living space.

14 Claims, 4 Drawing Sheets

10

INTERMODAL CONTAINER MODULAR UNIT

BACKGROUND OF THE INVENTION

1. Field of the Invention

The present invention relates to modular housing units and a method for assembling modular housing units from intermodal cargo containers.

2. Prior Art

Natural or man-made disasters frequently create a need for temporary housing that can be quickly transported to the site of the disaster and erected in a form suitable for human habitation. After-market intermodal shipping containers of the type used to transport cargo have been adapted to serve this need. For example, Wiley, Jr. et al., in U.S. Pat. No. 5,706,614 disclose a modular building having a steel shipping container core. Inner and outer wall coverings are secured to the corrugated side walls of the container and a laminate ceiling structure is secured to the interior surface of the container roof. A roof cap having a configuration corresponding to the roof of the container is mounted on the roof of the container, and the floor of the container provides a subflooring for the finished flooring of the building. The building thus formed has the disadvantage of having an aesthetically unappealing elevation. A building fabricated from a cargo shipping container disclosed byjohnson et al. in U.S. Pat. No. 5,761,654 is similarly aesthetically displeasing.

The problem of aesthetics has been partially overcome by Franz in U.S. Pat. No. 6,766,619. Franz discloses a kit of structural building elements for rapid erection and assembly to form a living space having a ridged roof, wherein the elements are linked together and comprise a central prism-like element and corresponding outer elements. The elements are arranged so that in a first state, suitable for transportation, they form an essentially cuboid structure having overall dimensions of a standard 40 foot cargo container and, in an erected state, the outer parts are raised to form a roof ridge line. Erection of a building using the kit can be effected without the need for heavy lifting machinery by pushing the outer elements inwardly so that they slide up the sloping faces of the prism like central part. While the resulting structure presents a more appealing elevation than the above-referenced structures of Wiley, Jr. et al. and Johnson et al., it is achieved at the cost of livable floor space.

SUMMARY

The present invention is directed to a transportable building structure and a method for fabrication from an intermodal cargo container that substantially obviates one or more of the limitations of the related art. To achieve these and other advantages and in accordance with the purpose of the invention, as embodied and broadly described herein, a triangular section is cut and removed from a center portion of a rectangular box comprising an intermodal cargo container. The remaining portion is folded to form a "L"-shaped structure. The triangular section is reinserted into the vertex of the "L" to form a substantially triangular modular unit. A door is cut therein to provide means for entering the building. Cargo containers ranging from 20-53 feet in length can be employed to provide up to 360 square feet of living space.

More particularly, a polygonal modular housing unit is described. It comprises an intermodal cargo container cut into three sections. Each of the three sections has a vertical cross section and a horizontal cross section. Each of the vertical cross sections is rectangular. The first horizontal cross section is a first trapezoid, the second horizontal cross sections is a second trapezoid, and the third horizontal cross sections is a right isosceles triangle. The right isosceles triangle has two equal sides, a base, a right angle opposite the base, and a vertical wall depending from the base. Each of the first and second trapezoids has a four-sided perimeter; three sides of the four-sided perimeter having vertical walls extending therefrom, the fourth side being open. The fourth open side of the first trapezoid is joined to the fourth open side of the second trapezoid forming a substantially "L" shaped structure. The substantially "L" shaped structure has an exterior corner and an opposing interior vertex angle. The interior vertex angle is a right angle and is flanked by two sides adjacent to the interior vertex angle. The two sides adjacent to the interior vertex angle are joined to the equal sides of the right isosceles triangle forming a polygonal modular housing unit. The vertical wall of the right isosceles triangle may include a door and a porch. The polygonal modular housing unit may further including interbox connections sites capable of receiving means for connection to other structures.

A substantially circular arrangement of four polygonal modular housing units can be configured. The substantially circular arrangement has a center and a circumference. The exterior corners of each of the four polygonal modular housing units faces towards the center. The substantially circular arrangement can be interspersed with walkways therebetween. It can also have a walkway surrounding the circumference, thereby defining a single story of modular housing units. A stacked arrangement of at least two stories of the modular housing units, including a central staircase and a roof, can be made.

A method of constructing a polygonal modular housing unit is described. It comprises the steps of, a. presenting an intermodal cargo container, b. cutting a triangular section from the midsection of the cargo container, c. mating the open ends of the two remaining pieces to form a substantially "L" shaped structure with an interior vertex angle and, d. mating the triangular section to the interior vertex angle.

The method of may further comprise the step of including a door and a porch. The method of may further comprise the step of including interbox connection sites.

A method of constructing a substantially circular arrangement of four polygonal modular housing units is described. The method comprises the steps of:

a. presenting four polygonal modular housing units as described above, and b. arranging the exterior corners of each of the four polygonal modular housing units towards the center of the circular arrangement.

The method of may further comprise the step of interspersing an interior walkway between each of the four polygonal modular housing units. The method of may further comprise the step of including a circumferential walkway surrounding the substantially circular arrangement of the four polygonal modular housing units. It may further comprise the step of including a central staircase and a roof.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION

The term Interbox Connection (IBC) site, is intended to describe the standard loop shaped auxiliary hardware used for wheel attachment or to join intermodal cargo containers together.

DESCRIPTION OF NUMERALS USED IN THE FIGURES

10—intermodal cargo container
11—orthogonal lines of cut
12—right angle defined by orthogonal lines of cut.
13—Interbox connection (IBC) site
20—left trapezoidal segment
21—right trapezoidal segment
22—right isosceles triangle
30—polygonal modular housing unit
31—entrance structure for polygonal modular housing unit
40—single story of multi-unit housing structure
41—central structure of multi-unit housing structure
42—system of circumferential and interspersing walkways surrounding units of multi-unit housing structure
50—multi-story structure of modular housing units
51—roof covering multi-story structure

DETAILED DESCRIPTION OF THE PREFERRED EMBODIMENT

The present invention discloses a polygonal modular housing unit constructed from an intermodal cargo container as well as a method of construction. The intermodal cargo container can be transported and cut on site. Alternatively, it can be precut prior to transportation and the separated parts releasably attached to one another to reform the container for shipment. Bolts and hinges provide means for reassembling the separated parts to provide a structure that is readily transported.

The design illustrated in the figures can be created using any size intermodal container, however those having a length of between 20 feet and 50 feet are easily transported by standard means. Such modular housing units can provide shelter for people in economically disadvantaged regions of the globe. More immediately, they can be used for disaster relief housing inasmuch as the containers are readily transported to any site and able to withstand exposure to severe weather conditions. A further advantage of the modular housing unit of the present invention is that it can be made from used cargo containers and the reuse of such containers extends the useful lifetime of the containers. Yet a further advantage of the present invention is that it maximizes useful floor space while providing a more aesthetically pleasing elevation than simply container-shaped buildings.

Figure 1:
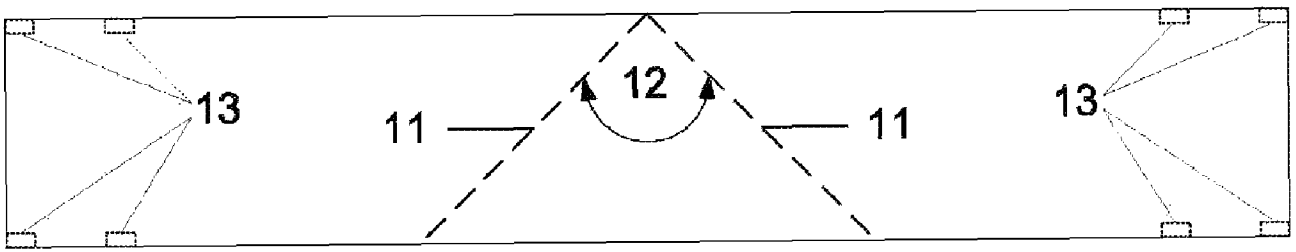
FIG. 1: Top view of an intermodal cargo container indicating the approximate lines of cut and the IBC site locations.
Figure 3:
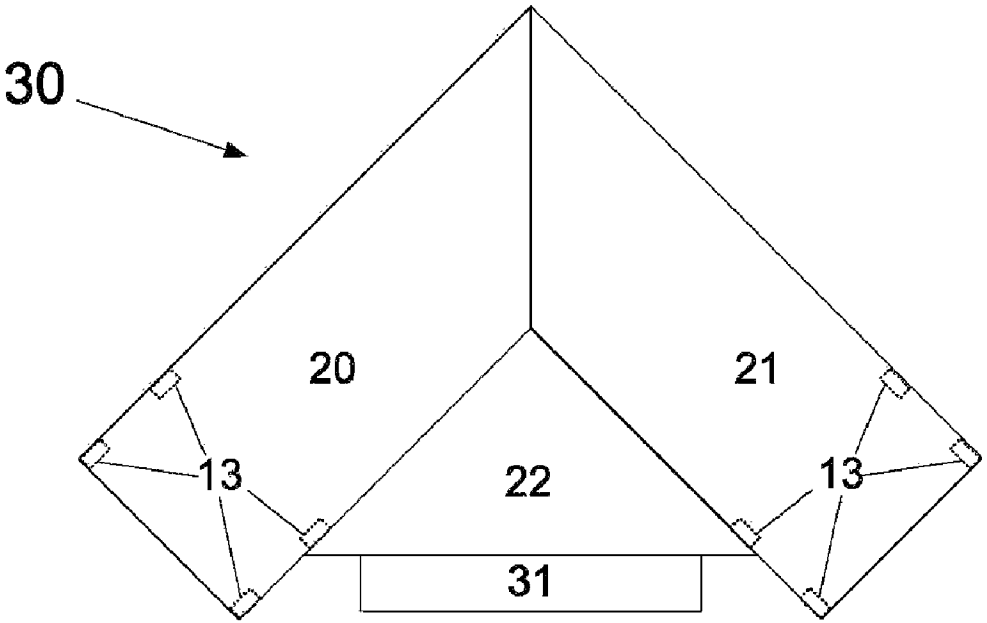
FIG. 3: Top view of a polygonal modular housing unit formed by rearrangement of intermodal cargo container segments.

FIG. 1 shows a top view of an intermodal cargo container (10). A polygonal modular housing unit (30), shown in FIG. 3, is fabricated by segmenting the structure as indicated by the orthogonal lines of cut (11), defining an interior right angle (12) therebetween. It should be noted that all vertical cross sections of the structure are rectangular. Noteworthy as well are the Interbox connection (IBC) sites (13) indicated in FIG. 1.

Figure 2:
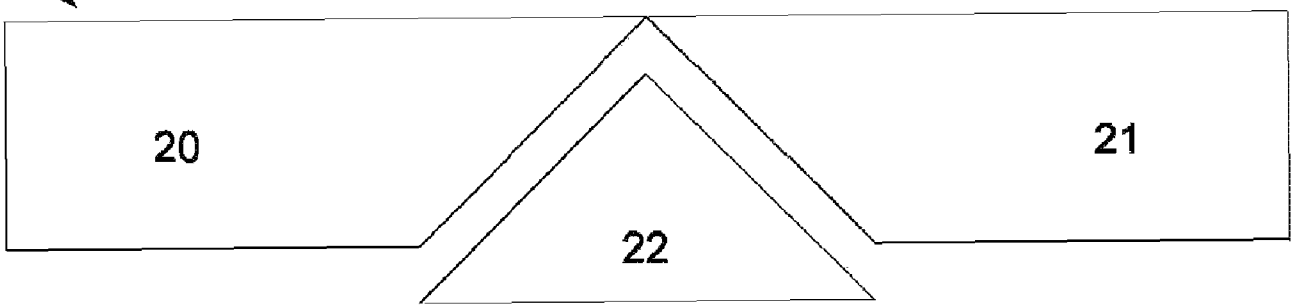
FIG. 2: Top view of an intermodal cargo container showing segmentation resulting from cutting procedure.

FIG. 2 indicates the segmentation of an intermodal cargo container (10) upon performing the cutting procedure. The midsection forms a right isosceles triangle (22). The side segments are trapezoidal. In the most general case, the left trapezoidal segment (20) need not be a mirror image of the right trapezoidal segment (21). However, as presented in the following discussion, mirrored segmentation offers some advantages with regards to the exploitation of IBC sites.

FIG. 3 illustrates a top view of the general shape of the resulting polygonal modular housing unit (30). The left trapezoidal segment (20) is welded or otherwise attached to the right trapezoidal segment (21), thereby forming a substantially "L" shaped structure with a right interior vertex angle opposite an exterior corner. The right angled exterior corner of the right isosceles triangle (22) is mated with the right interior vertex angle of the "L" shaped structure and secured by welding or other appropriate means. An entrance structure (31) and a door can then be added to provide access to the inter space formed therewithin.

The IBC sites (13) can facilitate attachment of the right isosceles triangle (22) to both the left trapezoidal segment (20) and the right trapezoidal segment (21) with the addition of appropriate IBC attachment means. Such means may comprise similar IBC apparatus, modified to conform to the particular geometrical configuration of the attachment interface. The apparatus may include wheels to facilitate mobility.

Figure 4:
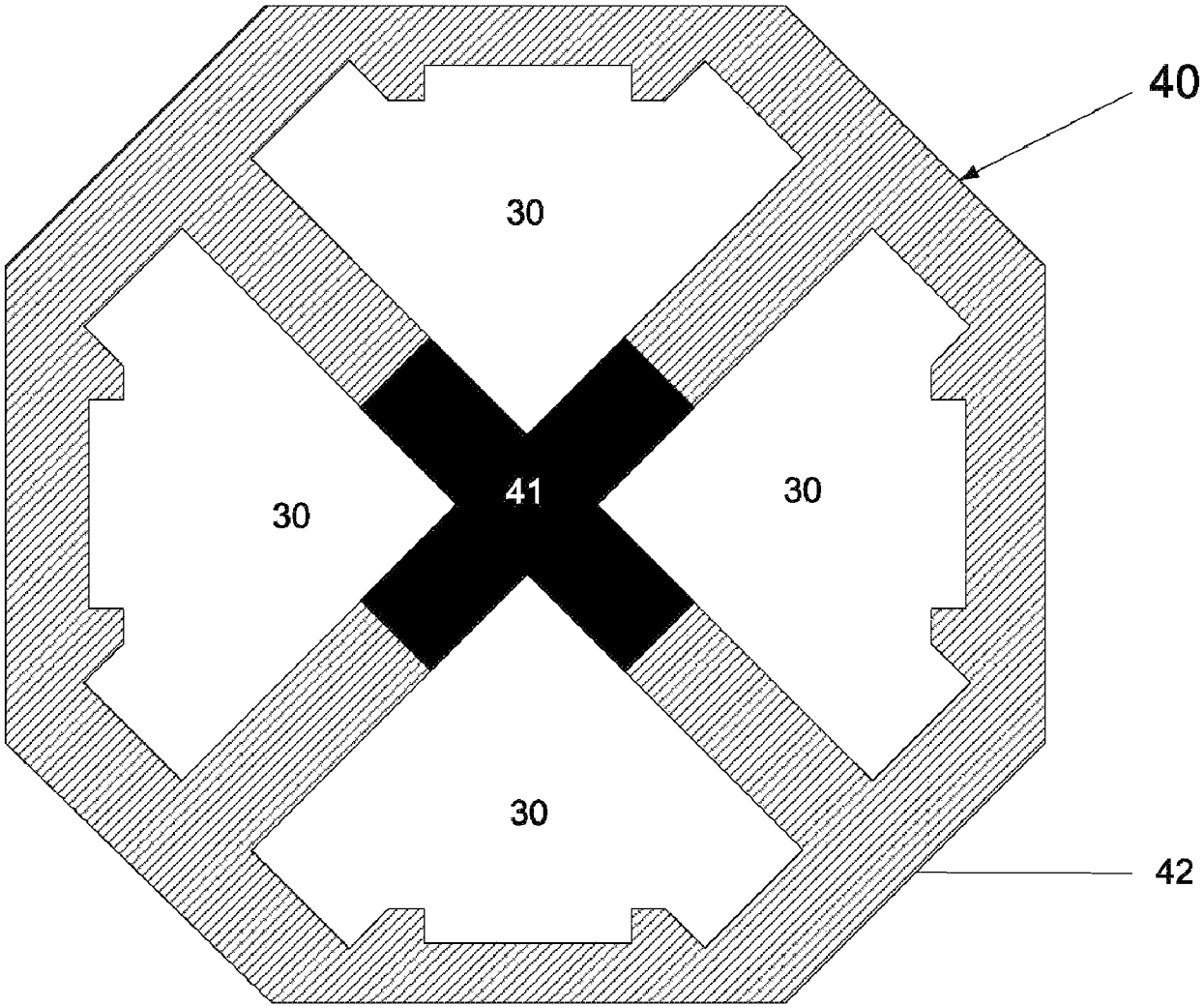
FIG. 4: Single story of a multi-unit housing structure comprising four polygonal modular housing units interspersed with adjacent walkways.

FIG. 4 shows an arrangement of four polygonal modular housing units (30) including a system of circumferential and interspersing walkways (42). This arrangement can form a single story of a multi-unit housing structure (40). An optional central structure (41) may include a shaded seating area.

Figure 5:
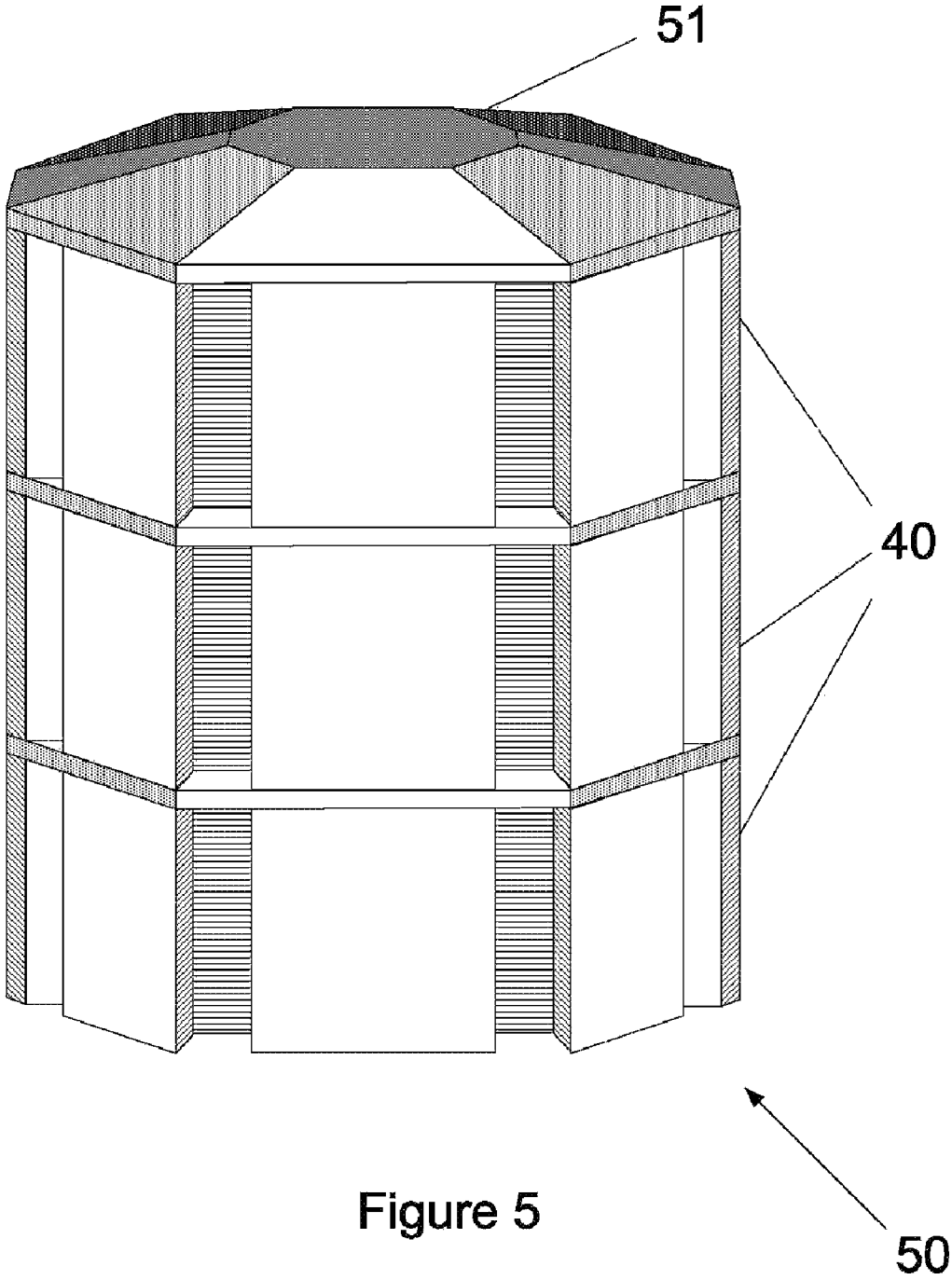
FIG. 5: Multi-story structure of modular housing units

FIG. 5 illustrates a multi-story structure (50) of modular housing units (30), arranged in single story (40) groupings of four as indicated in the previous figure. A roof (51) covers the entirety of the multi-story structure (50). Here, it is appropriate to use the central structure (41) as a stairwell, thereby providing access between the stories.

While particular embodiments of the present invention have been illustrated and described, it would be obvious to those skilled in the art that various other changes and modifications can be made without departing from the spirit and scope of the invention. For example, the corrugated surfaces of standard intermodoal cargo containers can be used to contain and circulate water as part of an over all cooling system. Pumps can be used to circulate water from a ground level reservoir to an array of corrugation troughs on the top surface of the container. Vertical corrugation troughs provide a natural pathway to facilitate such transport. Insulation properties of the intermodal cargo container walls can be improved via the use of paint enriched with ceramic microspheres, i.e. tiny, hollow spheres with remarkable insulating properties due to the vacuum maintained by their internal void. IBC sites can be utilized to "yoke" two or more units together, or to a third structure. It is therefore intended to cover in the appended claims all such changes and modifications that are within the scope of this invention.

The invention claimed is:

1. A polygonal modular housing unit comprising, an intermodal cargo container, wherein said intermodal cargo container is cut into three sections, each of said three sections having a vertical cross section and a horizontal cross section, wherein each of said vertical cross sections is rectangular, wherein the first of said horizontal cross sections is a first trapezoid, the second of said horizontal cross sections is a second trapezoid, and the third of said horizontal cross sections is a right isosceles triangle, wherein said right isosceles triangle has two equal sides, a base, a right angle opposite said base, and a vertical wall depending from said base, wherein each of said first and second trapezoids has a four-sided perimeter, three sides of said four-sided perimeter having vertical walls extending therefrom, said fourth side being open, wherein said fourth open side of said first trapezoid is joined to said fourth open side of said second trapezoid forming a substantially "L" shaped structure, said substantially "L" shaped structure having an exterior corner and an opposing interior vertex angle, wherein said interior vertex angle is a right angle, said interior vertex angle being flanked by two sides adjacent to said interior vertex angle, and wherein said two sides adjacent to said interior vertex angle are joined to said equal sides of said right isosceles triangle, thereby forming a polygonal modular housing unit.

2. A polygonal modular housing unit as in claim 1 wherein said vertical wall of said right isosceles triangle includes a door and a porch.

3. A polygonal modular housing unit as in claim 1 further including interbox connections sites, said interbox connections sites being capable of receiving means for connection to other structures.

4. A substantially circular arrangement of four polygonal modular housing units as in claim 1, said substantially circular arrangement having a center and a circumference, wherein said exterior corners of each of said four polygonal modular housing units faces towards said center.

5. A substantially circular arrangement as in claim 4, wherein each of said four polygonal modular housing units is interspersed with a walkway therebetween.

6. A substantially circular arrangement as in claim 5, further comprising a walkway surrounding said circumference of said substantially circular arrangement, thereby defining a single story of modular housing units.

7. A stacked arrangement of at least two stories of said modular housing units as in claim 6, further including a central staircase and a roof.

8. A method of constructing a polygonal modular housing unit comprising the steps of, a) presenting an intermodal cargo container, b) cutting a triangular section from the midsection of the cargo container, c) mating the open ends of the two remaining pieces to form a substantially "L" shaped structure with an interior vertex angle and, d) mating the triangular section to the interior vertex angle.

9. A method of constructing a polygonal modular housing unit as in claim 8 further comprising the step of including a door and a porch.

10. A method of constructing a polygonal modular housing unit as in claim 8 further comprising the step of including interbox connection sites.

11. A method of constructing a substantially circular arrangement of four polygonal modular housing units comprising the steps of:

a) presenting four polygonal modular housing units as in claim 2, AND b) arranging the exterior corners of each of said four polygonal modular housing units towards the center of said circular arrangement.

12. A method of constructing a single story of a substantially circular arrangement of four polygonal modular housing units as in claim 11 further comprising the step of interspersing an interior walkway between each of said four polygonal modular housing units.

13. A method of constructing a single story of a substantially circular arrangement of four polygonal modular housing units as in claim 12 further comprising the step of including a circumferential walkway surrounding said substantially circular arrangement of said four polygonal modular housing units.

14. A method of constructing a stacked arrangement of at least two stories of said single stories of a substantially circular arrangement of four polygonal modular housing units as in claim 13 further comprising the step of including a central staircase and a roof.

* * * * *